US006929125B1

(12) United States Patent
Seamans

(10) Patent No.: US 6,929,125 B1
(45) Date of Patent: Aug. 16, 2005

(54) WATERTIGHT PROTECTIVE CARRYING CASE

(75) Inventor: Scott A. Seamans, Longmont, CO (US)

(73) Assignee: Foam Technologies, Inc., Longmont, CO (US)

( * ) Notice: Subject to any disclaimer, the term of this patent is extended or adjusted under 35 U.S.C. 154(b) by 231 days.

(21) Appl. No.: 10/202,141

(22) Filed: Jul. 25, 2002

(51) Int. Cl.[7] ..... B65D 85/38
(52) U.S. Cl. ..... 206/316.1; 190/28; 383/113
(58) Field of Search ..... 206/316.1–316.3, 206/523; 190/28, 119, 125, 903; 220/849; 383/97, 113

(56) References Cited

U.S. PATENT DOCUMENTS 1,314,399 A 8/1919 Hicks
2,515,715 A 7/1950 Jones
2,803,368 A * 8/1957 Koch ..... 190/28
3,088,623 A 5/1963 Parker
3,189,074 A * 6/1965 Schaeffer ..... 383/97
3,730,309 A 5/1973 Hamann et al.
4,703,519 A 10/1987 Krenzel
4,712,657 A 12/1987 Myers et al.
4,830,182 A * 5/1989 Nakazato et al. ..... 220/849
4,905,857 A 3/1990 Her
5,201,867 A * 4/1993 Morszeck ..... 206/316.2
5,996,790 A 12/1999 Yamada et al.
6,068,113 A 5/2000 Schmaling et al.

OTHER PUBLICATIONS

Evans Sports, Inc.; Coverz Sport Boxes, 2001, Advertisement (Flyer).

* cited by examiner

*Primary Examiner*—Luan K. Bui
(74) *Attorney, Agent, or Firm*—Harold A. Burdick

(57) ABSTRACT

A watertight protective carrying case having first and second case body portions each including an outer containment and inner frame. Engageable lips are formed at one part of each inner frame, the lips matable in a sealing relationship when the case is in a closed condition. A cooperative closure assembly is configured and mounted at the outer containments so that upon engagement of the cooperative closure compressive pressure is applied at the frame lips with the engagable lips entirely enclosed by the cooperative closure. The compression thus effected by engagement of the closure is substantially constant at all locations along the interface of the lips thereby providing a tight seal of the entire interface with no need for the closure itself to be watertight.

19 Claims, 2 Drawing Sheets

WATERTIGHT PROTECTIVE CARRYING CASE

FIELD OF THE INVENTION

This invention relates to protective cases, and, more particularly, relates to protective cases utilizing a watertight seal at their opening.

BACKGROUND OF THE INVENTION

A wide variety of sealable, watertight containing devices have heretofore been suggested and/or utilized. In particular, the use of various tongue and groove joints at container segments, with a sealing medium interposed therebetween, have been suggested, many of which make use of snaps, buckles, latches, or the like to cause compression sealing at the container joints (see, for example, U.S. Pat. Nos. 4,905,857, and 4,712,657). Some such devices have made use of multi-element structures, such as interposed multi-element rings between container body segments, to accomplish various desired structures (see, for example, U.S. Pat. Nos. 3,730,309, 3,088,623 and 2,515,715). Such devices have not always provided for a tight seal due to uneven application of pressure by the mechanisms heretofore utilized to hold the container closed at the container segments' interface, thereby allowing leaks at the containment area. In addition, such containing devices are often unattractive and/or difficult and cumbersome to access.

Other watertight structures have relied upon watertight closures (such as known waterproof zippers and the like) to establish a watertight containment area (see U.S. Pat. No. 5,996,790). However, such slide closures are also often unreliable and susceptible to leaks, and are quite expensive and thus not adaptable to a variety of uses. Multi-container structures, some sealable, have also been suggested (see U.S. Pat. Nos. 6,068,113 and 1,314,399), though such devices are too complex and thus expensive to produce for many applications. As may be appreciated, further improvements could be utilized.

SUMMARY OF THE INVENTION

This invention provides a reliably watertight carrying case that is relatively impact and crush resistant, that provides an even application of sealing pressure at container joints, and that is attractive, easy to access, and inexpensive to produce.

The case includes a first case body portion having an intersectable lip circumscribing an open side and a second case body portion with an engaging lip circumscribing an opening thereat. The engaging lip of the second case body portion is matable with the intersectable lip of the first case body portion when the protective case is closed, a compressible sealing preferably being held at the intersectable lip of the first case body portion. A cooperative closure, including sections located at different ones of the case body portions, entirely encloses the lips of the case body portions when the sections of the cooperative closure are engaged, the cooperative closure operative to cause compression at the lips of the case body portions that is substantially constant at all locations therealong to provide a substantially constant seal at the lips' interface. The case is thus made watertight without the cooperative closure itself being watertight.

Each case body portion includes an outer containment having a surface adjacent to a relatively deformable upstanding wall with a section of the cooperative closure attached thereto. An inner frame, preferably a ring structure, is joined at one open side to the surface of the outer containment in a watertight relationship thereat, the frames each having one of the lips defined at an opposite open side thereof. The inner frames are preferably made of material that is relatively more rigid than material forming the outer containments.

The inner frames are preferably defined by an endless wall, the endless walls of the inner frames and the upstanding walls of the outer containments being adjacent one another with at least one of the endless walls extending beyond its adjacent upstanding wall. The case body portions may be hingedly connected.

It is therefore an object of this invention to provide an improved watertight protective carrying case.

It is another object of this invention to provide a reliably watertight case that is relatively impact and crush resistant.

It is still another object of this invention to provide a watertight protective carrying case wherein a closure applies an even application of sealing pressure at container access joints.

It is yet another object of this invention to provide a watertight protective carrying case that is attractive, easy to access, and inexpensive to produce.

It is still another object of this invention to provide a watertight protective case including a first case body portion with an intersectable lip circumscribing an open side thereof, a second case body portion with an engaging lip circumscribing an opening thereat, the engaging lip of the second case body portion matable with the intersectable lip of the first case body portion when the protective case is in a closed condition, a compressible sealing maintained at the intersectable lip of the first case body portion, and a cooperative closure including sections located at different ones of the case body portions so that the lips of the case body portions are entirely enclosable by the cooperative closure when the sections are engaged, the cooperative closure operative to cause compression of the sealing at the intersectable lip of the first case body portion by the engaging lip of the second case body portion that is substantially constant at all locations along the sealing when the case is in the closed condition and the cooperative closure sections are engaged.

It is yet another object of this invention to provide a watertight and relatively impact resistant protective case including first and second outer containments each having a surface adjacent to a relatively deformable upstanding wall, first and second inner rings each joined at one open side to a different one of the surfaces of the first and second outer containments in a watertight relationship thereat, the rings each having an engageable lip defined at an opposite open side thereof, the lips of the first and second inner rings matable in a sealing relationship with each other, the first and second inner rings made of material that is relatively more rigid than material forming the first and second outer containments, and a cooperative closure having different sections located at different ones of the upstanding walls of the first and second outer containments so that the lips of the inner rings are entirely enclosable by the cooperative closure when the sections are engaged, the cooperative closure operative to secure substantially constant sealing at all locations along the enagagable lips of the first and second inner rings when the lips are mated and the sections of the cooperative closure are engaged.

It is yet another object of this invention to provide a watertight protective carrying case including a first case body portion with a first outer containment and a first inner frame, the first outer containment having a surface adjacent to an upstanding wall, and the first inner frame defined by an endless wall joined at one open side to the surface of the first outer containment in a watertight relationship thereat and having an engageable lip defined at an opposite open side thereof, the endless wall of the first inner frame and the upstanding wall of the first outer containment being adjacent one another with the endless wall extending beyond the upstanding wall, a second case body portion hingedly connected with the first case body portion and including a second outer containment and a second inner frame, the second outer containment having a surface adjacent to an upstanding wall, and the second inner frame defined by an endless wall joined at one open side to the surface of the second outer containment in a watertight relationship thereat and having an engageable lip defined at an opposite open side thereof, the lips of the endless walls of the first and second inner frames matable in a sealing relationship with each other, and a cooperative closure including sections located at different ones of the case body portions so that the lips of the endless walls of the first and second inner frames are entirely enclosable by the cooperative closure when the sections are engaged, the cooperative closure operative to secure substantially constant sealing at all locations along the enagagable lips of the endless walls of the first and second inner frames when the lips are mated and the sections of the cooperative closure are engaged without the cooperative closure itself being watertight.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
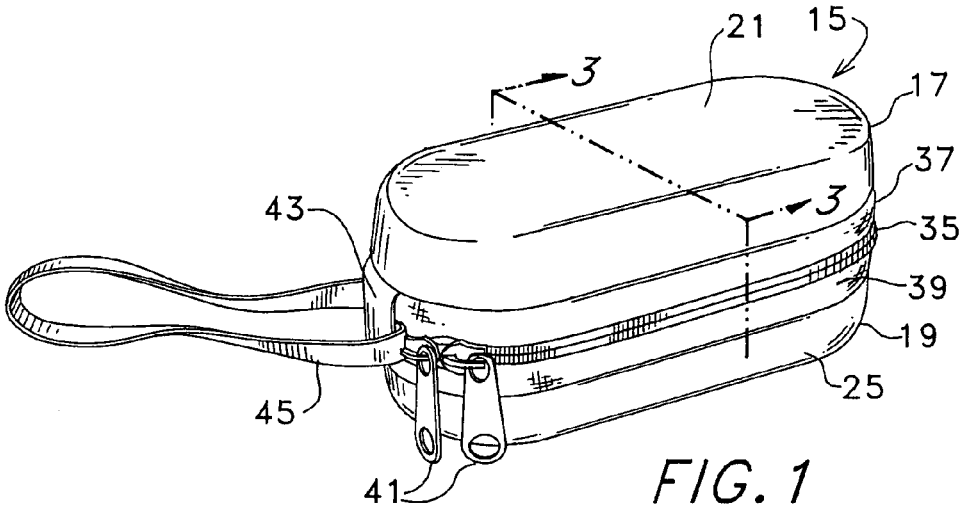
FIG. 1 is a perspective view of a protective case of this invention.
Figure 2:
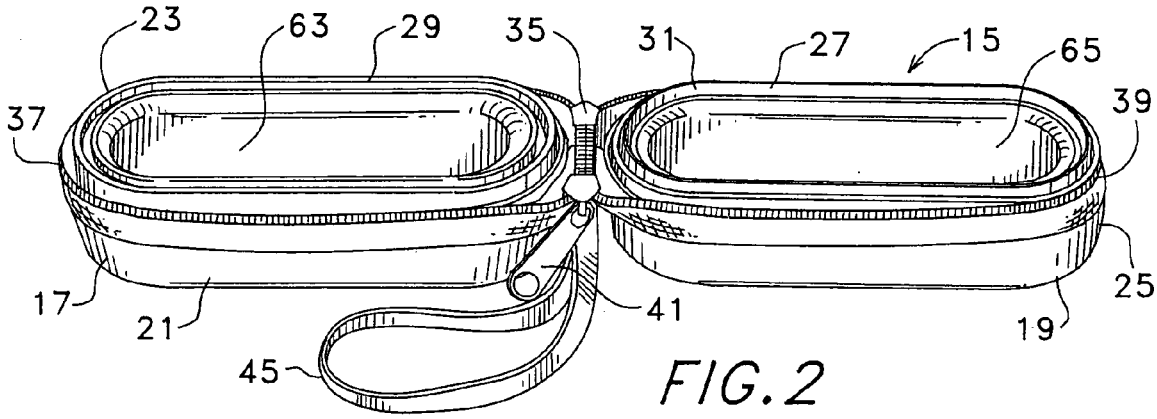
FIG. 2 is as second perspective view of the protective case shown in FIG. 1.
Figure 3:
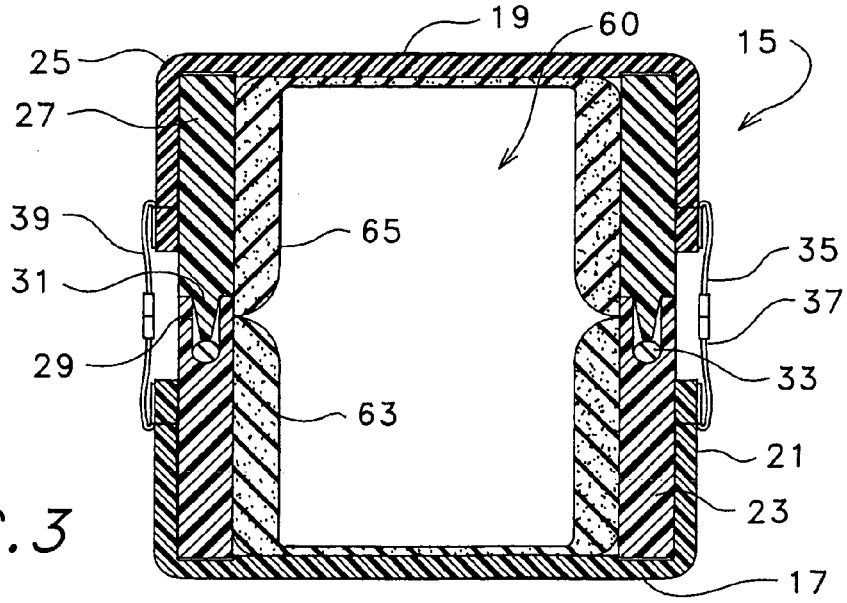
FIG. 3 is a sectional view of the protective case taken through section lines 3—3 of FIG. 1.

An exemplary embodiment of this invention is illustrated in FIGS. 1 through 4. It should be understood that different applications of this invention will entail varying configuration or combination of the invention to suit the application.

Watertight protective carrying case 15 includes first and second case body portions 17 and 19. Case body portion 17 includes outer containment 21 and inner frame 23, case body portion 19 including outer containment 25 and inner frame 27. For purposes of this embodiment of the invention, outer containments 21 and 25 are substantially identically configured, and frames 23 and 27 are of substantially the same size, and include engageable lips 29 and 31, respectively, at one side thereof which are matable in a sealing relationship when the case is in a closed condition.

The particular sealing relationship at lips 29 and 31 is caused by compression exerted at the interface between the lips, and may take any of numerous suitable configurations thus operative. In this embodiment, which is preferred, intersectable groove structure is formed at lip 29 and engaging tongue structure is formed at lip 31. Compressible sealing 33 is held in the groove structure of lip 29 (as shown herein an o-ring or similar type of neoprene cord, though any effective seal such as gasket materials including silicone tubing or die cut closed cell foam, cork, various poured sealant compounds, or any other material capable of establishing a repeatable seal could be utilized in the preferred embodiment of this invention). While a round sealing is shown, other cross-sectional shapes could be extruded and utilized.

Cooperative closure assembly 35, herein a zipper-type slide fastener assembly, is configured, sized and mounted at outer containments 21 and 25 of case body portions 17 and 19, respectively, so that compressive pressure is applied at lips 29 and 31 with the engagable lips entirely enclosed by the cooperative closure when the case is in the closed and sealed condition. In particular, assembly sections 37 and 39 (fabric mounted teeth or spirals) are mounted (sewn for example) to outer containments 21 and 25 respectively and are engagable by operation of slide or slides 41.

When case 15 is closed, with lips 29 and 31 mated, and sections 37 and 39 are engaged, cooperative closure 35 causes compression of sealing 33 in the groove of lip 29 by the tongue of lip 31. The compression thus effected by engagement of the closure sections is substantially constant at all locations along the interface of lips 29 and 31, and thus at sealing 33, thereby providing a quite efficacious seal of the entire interface with no need for closure 35 itself to be watertight. While a zipper-type closure is shown herein, other types of closures could be utilized (such as a ZIPLOC type of slide fastening system, or other types of securement systems capable of effecting the necessary constant application of compressive pressure when case 15 is closed).

Fabric hinge 43 and hand strap 45 are applied at outer containments 21 and 25 in this embodiment, though other applications may require other arrangements (hingeless, handles or the like).

Figure 4:
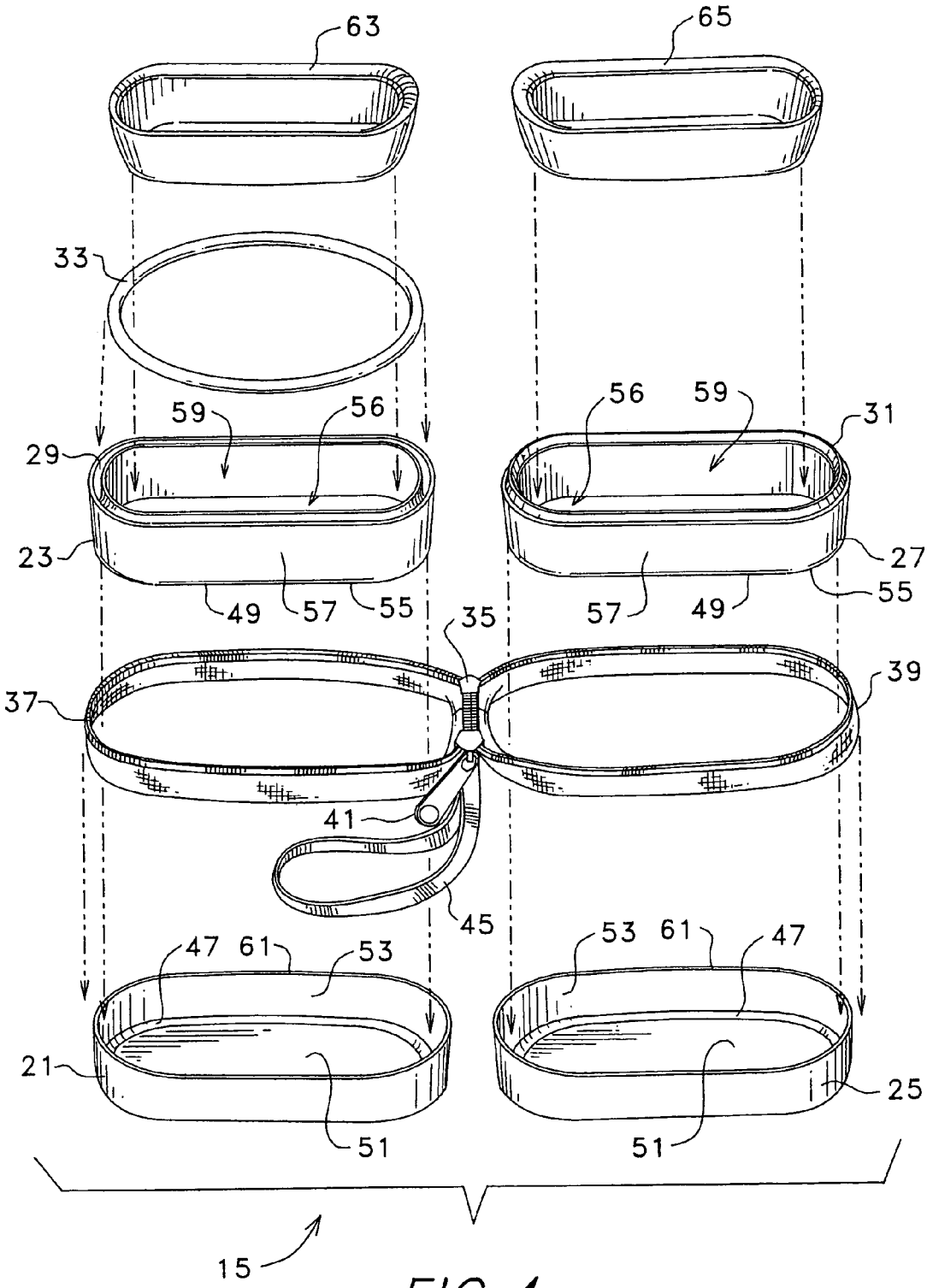
FIG. 4 is an exploded view of the protective case of FIG. 1.

Turning to FIG. 4, the particular structures associated with case body portions 17 and 19 are shown. Inner frames 23 and 27 are preferably unitary ring structures (a "ring" structure being defined, for purposes of this application, as any endless structural configuration without regard to shape; i.e., not necessarily circular, annular or otherwise curvilinear). Outer containment 21 and inner frame 23, and outer containment 25 and inner frame 27, are each joined in a watertight relationship at boundary areas 47 and 49 thereof, respectively (for example, by gluing, though the parts could be welded or otherwise fixed in a leak proof arrangement).

Boundary areas 47 of outer containments 21 and 25 are grooves at planar surfaces 51 adjacent to upstanding walls 53 thereof. Boundary areas 49 of frames 23 and 27 are the bottom surfaces 55 at open side 56 opposite endless wall 57 from lips 29/31 at open side 59 of the frames. As may be appreciated, this watertight arrangement at boundary areas 47 and 49 between the outer containments and inner frames of the case body portions, together with the sealing relationship established at lips 29 and 31 of frames 23 and 27, respectively, as discussed hereinabove, provide the means for maintaining a watertight space 60 within case 15 when the case is in the closed and sealed condition (see FIG. 3).

One or both upstanding walls 53 of containments 21 and 25 are preferably relatively deformable (i.e., more pliant than frames 23 and/or 27). One or both endless walls 57 of frames 23 and 27 is preferably made of material relatively more rigid than the material utilized to form one or both of the outer containments 21 and 25. The dimension of endless walls 57 between open sides 56 and 59 is greater at one or both case body portions 17 and/or 19 than height between surface 51 and terminal edge 61 of upstanding walls 53. Thus, at least one, and preferably both, of endless walls 57 extend beyond their related adjacent upstanding wall 53 when assembled. Care should be taken when designing this relationship for any particular embodiment of the case of this invention (though clearly variable in different embodiments) so that, when cooperative closure 35 is attached, sufficient pressure is applied at lips 29/31 when closure sections 37 and 39 are engaged to effect the seal thereat.

Selectively configured inner padding/liners 63 and/or 65 may be provided at case body portions 17 and/or 19 to further cushion and protect case contents. Any shape for such padding may be utilized, either adapted for particular goods to be carried, or randomly configured. The inner padding/liner may be made of known materials for such purpose (for example, foam or foam fabric laminate, die cut inserts or the like). Padding/liner 63/65 may be attached (glued for example) to the case body portion at frame 23/27 or surface 51 of outer containment 21/25, or may be merely nestable in each assembled case body portion and thus removable. Moreover, many embodiments of this invention will be conceived wherein no such padding/liner is desirable and/or where form fitting of contained articles is established during molding of the outer containments and/or frames of the case body portions.

Outer containments 21 and 25 could be covered in fabric, the fabric connected to the cooperative closure 35 directly or in combination with the connection of the closure to the outer containment.

Outer containments 21 and 25 may be thermo-molded plastic of known varieties, though injection molded foam or plastic could be utilized. Using these methods, an inexpensive, homogeneous molded form with a finished look is established to which cooperative closure 35 can be attached and frames 23 and 27 are readily bonded. Other forms of the invention (deeper or shallower containments 21/25) would advantageously be cut and sewn using known fabrics, materials and techniques. In all cases it should be noted that only surface 51 to boundary area 47 need be waterproof. Multi-element plastic containments could also be conceived (for example, for much larger or complex forms), R.F. or sonic welding being utilized to join the elements. Metal outer containments (aluminum for example) could also be utilized.

Waterproof frames 23 and 27 should be lightweight, rigid and easily bondable. Plastics such as high impact styrene, ABS, polycarbonate or the like would be suitable, preferably formed by injection molding or similar technique. Cast or machined metal could be used in some cases.

What is claimed is:

1. A watertight and relatively impact resistant protective case comprising:

first and second outer containments each having a surface adjacent to a relatively deformable upstanding wall;

first and second inner rings each joined at one open side to a different one of said surfaces of said first and second outer containments in a watertight relationship thereat, said rings each having an engageable lip defined at an opposite open side thereof, said lips of said first and second inner rings matable in a sealing relationship with each other;

a cooperative closure having different sections located at different ones of said upstanding walls of said first and second outer containments so that said lips of said inner rings are entirely enclosable by said cooperative closure when said sections are engaged, said cooperative closure sections and said upstanding walls dimensioned to secure substantially constant and watertight pressure at all locations along said enagagable lips of said first and second inner rings when said lips are mated and said sections of said cooperative closure are engaged; and a hinge connecting said first and second outer containments.

2. The case of claim 1 further comprising a compressible sealing maintained at said engageable lip of said first inner ring, said cooperative closure operative to cause compression of said sealing at said engageable lip of said first inner ring by said engageable lip of said second inner ring when said cooperative closure sections are engaged.

3. The case of claim 1 wherein said inner rings are made of material relatively more rigid than said relatively deformable upstanding walls of said outer containments.

4. The case of claim 1 wherein said outer containments each have a groove at said surface adjacent to said relatively deformable upstanding walls thereof, a different one of said rings seatable at each of said groove.

5. The case of claim 1 further comprising a carrying strap associated with at least one of said outer containments.

6. The case of claim 1 further comprising a padded liner configured to be housed in said case adjacent to said first and second inner rings.

7. The case of claim 1 wherein said cooperative closure is a zipper that need not itself be watertight.

8. A watertight and relatively impact resistant protective case comprising:

first and second outer containments each having a surface adjacent to a relatively deformable upstanding wall;

first and second inner rings each joined at one open side to a different one of said surfaces of said first and second outer containments in a watertight relationship thereat, said rings each having an engageable lip defined at an opposite open side thereof, said lips of said first and second inner rings matable in a sealing relationship with each other; and a cooperative closure having different sections located at different ones of said upstanding walls of said first and second outer containments so that said lips of said inner rings are entirely enclosable by said cooperative closure when said sections are engaged, said cooperative closure sections and said upstanding walls dimensioned to secure substantially constant and watertight pressure at all locations along said enagagable lips of said first and second inner rings when said lips are mated and said sections of said cooperative closure are engaged.

9. The case of claim 8 wherein each of said inner rings is defined by an endless wall having a dimension between said open sides greater than height of a said upstanding wall of said outer containment, said first and second inner rings made of material that is relatively more rigid than material forming said upstanding walls of said first and second outer containments.

10. The case of claim 8 wherein one of said engageble lips is a tongue and the other of said engageble lips is a groove.

11. The case of claim 10 further comprising a compressible sealing maintained in said groove.

12. The case of claim 11 wherein said tongue compresses said sealing in said groove when said engageable lips are mated and said cooperative closure sections are engaged.

13. The case of claim 8 wherein said cooperative closure is a zipper.

14. The case of claim 13 further comprising means for movably associating said first and second outer containments adjacent to said zipper and allowing continued association of said first and second outer containments when said zipper is when said different sections are not engaged.

15. A watertight protective carrying case comprising:

a first case body portion including a first outer containment and a first inner frame, said first outer containment having a surface adjacent to an upstanding wall, and said first inner frame defined by an endless wall joined at one open side to said surface of said first outer containment in a watertight relationship thereat and having an engageable lip defined at an opposite open side thereof, said endless wall of said first inner frame and said upstanding wall of said first outer containment being adjacent one another with said endless wall extending beyond said upstanding wall;

a second case body portion hingedly connected with said first case body portion and including a second outer containment and a second inner frame, said second outer containment having a surface adjacent to an upstanding wall, and said second inner frame defined by an endless wall joined at one open side to said surface of said second outer containment in a watertight relationship thereat and having an engageable lip defined at an opposite open side thereof, said endless wall of said second inner frame and said upstanding wall of said second outer containment being adjacent one another with said endless wall of said second inner frame extending beyond said upstanding wall of said second outer containment, said lips of said endless walls of said first and second inner frames matable in a sealing relationship with each other; and a cooperative closure including sections located at different ones of said case body portions so that said lips of said endless walls of said first and second inner frames are entirely enclosable by said cooperative closure when said sections are engaged, said cooperative closure sections dimensioned to secure substantially constant and watertight sealing pressure at all locations along said enagagable lips of said endless walls of said first and second inner frames when said lips are mated and said sections of said cooperative closure are engaged without said cooperative closure itself being watertight.

16. The case of claim 15 further comprising selectively configured inner padding at at least one of said case body portions.

17. The case of claim 15 wherein said engageble lip of said endless wall of said first inner frame is a groove structure and said engageble lip of said endless wall of said second inner frame is a tongue structure, a compressible sealing maintained in said groove structure, said cooperative closure operative to cause compression of said sealing in said groove structure by said tongue structure when said sections of said cooperative closure are engaged.

18. The case of claim 15 wherein at least one of said upstanding walls of said outer containments of said first and second case body portions is relatively deformable.

19. The case of claim 15 wherein said inner frames of said first and second case body portions are made of material that is relatively more rigid than material forming said outer containments of said first and second case body portions.

* * * * *